US005129682A

United States Patent [19]

Ashby

[11] Patent Number: 5,129,682

[45] Date of Patent: Jul. 14, 1992

[54] BUSINESS FORM WITH LABELS

[75] Inventor: Robert E. Ashby, Quakertown, Pa.

[73] Assignee: Moore Business Forms, Inc., Grand Island, N.Y.

[21] Appl. No.: 662,946

[22] Filed: Mar. 1, 1991

[51] Int. Cl.[5] ..... B42D 15/00

[52] U.S. Cl. ..... 283/81; 283/101; 281/5; 428/41; 428/77; 40/299; 462/3

[58] Field of Search ..... 283/61, 62, 67, 81, 283/101; 281/5; 428/41, 42, 77; 40/299; 462/2, 3

[56] References Cited

U.S. PATENT DOCUMENTS

| | | | |
|---|---|---|---|
| 3,166,186 | 1/1965 | Karn | 206/56 |
| 3,226,862 | 1/1966 | Gabruk | 40/2 |
| 3,464,883 | 9/1969 | Moline et al. | 161/167 |
| 4,150,183 | 4/1979 | Reed | 428/42 |
| 4,246,058 | 1/1981 | Reed | 156/183 |
| 4,274,661 | 6/1981 | Jenkins | 283/62 X |
| 4,379,573 | 4/1983 | Lomeli et al. | 428/42 |
| 4,627,994 | 12/1986 | Welsch | 428/41 |
| 4,696,843 | 9/1987 | Schmidt | 428/41 |
| 4,799,712 | 1/1989 | Biava et al. | 282/1 |
| 4,810,006 | 3/1989 | Katz | 283/62 X |
| 4,814,216 | 3/1989 | Brunett et al. | 283/61 |
| 4,854,610 | 8/1989 | Kwiatek | 282/11.5 |
| 4,910,058 | 3/1990 | Jameson | 428/42 |
| 4,951,970 | 8/1990 | Burt | 283/67 |
| 4,952,433 | 8/1990 | Tezuka et al. | 428/42 |

*Primary Examiner*—Timothy V. Eley
*Assistant Examiner*—Willman Fridie, Jr.
*Attorney, Agent, or Firm*—Nixon & Vanderhye P.C.

[57] ABSTRACT

A business form having a removable label associated with it is made from a paper ply and a piece of transfer tape. The adhesive face of the transfer tape is attached to the paper ply rear face with the side edges of the transfer tape between tractor openings in the paper ply. At least one die cut is formed in the paper ply front face to define, with adhesive from the transfer tape, at least one label, and preferably a plurality of labels. A perforation may be provided in the paper ply at the interior-most edge of the transfer tape, and at the tractor openings most remote from the transfer tape. The paper ply may be the top ply of a multi ply form. During manufacture of the form, the die cut area surrounding the lables is removed to expose the release portion of the transfer tape, and that part of the form remote from the transfer tape, as well as the labels, can be simultaneously printed as the form is fed through a printer utilizing the tractor openings.

20 Claims, 2 Drawing Sheets

BUSINESS FORM WITH LABELS

BACKGROUND AND SUMMARY OF THE INVENTION

There are many types of business forms in which it is desirable to have at least one label associated with the form that is removable from the form. For example, in mailers the label or labels can provide a return address to the sender, or can provide selective material that may be easily removed from and applied to the rest of the form before it is mailed back, kept as a record copy, or otherwise acted upon. Such forms allow for the completion of a wide variety of different business transactions in a simple, convenient manner.

Utilizing the teachings of the present invention, a business form having at least one removable label can be quickly and easily constructed. The constructed form can readily be run through a computer controlled printer in continuous format, or in sheet format if desired. The method of manufacture of the form is also simple yet effective.

According to one aspect of the present invention, a business form having at least one label associated with it and removable from it is provided. The business form comprises: A paper ply having a front face and a rear face, and having first and second side edges parallel to each other and having means defining tractor feed openings adjacent the first and second edges. A piece of transfer tape having an adhesive covered release face and a non-adhesive covered back face, and a pair of parallel side edges. The adhesive face of the transfer tape is attached to the paper ply rear face with the side edges of the transfer tape between the tractor openings adjacent the first and second edges of the paper ply, and the transfer tape edges parallel to the first and second edges. And, at least one die cut formed in the paper ply front face to define, with adhesive from the transfer tape, at least one removable label.

The paper ply has top and bottom edges and the transfer tape preferably extends from the top edge to the bottom edge. The distance between the tractor openings is much greater than the spacing between the side edges of the transfer tape, e.g. at least twice as great. A perforation is preferably formed in the paper ply approximately at one of the side edges of the transfer tape, and the at least one label preferably comprises a plurality of labels. A die cut area is provided surrounding the labels, and the die cut area is removed so that the release face of the transfer tape is exposed at the edges of the labels. A perforation is also formed at the first edge of the paper ply just inside the tractor openings adjacent the first edge, the perforation being spaced a significant distance from the transfer tape, and an edge of the transfer tape is adjacent, but spaced from, the tractor openings adjacent the second edge of the transfer tape. While the business form may comprise a single part form, the paper ply may also comprise the top ply of a multi ply (e.g. two, three, or four or more parts) form.

According to the method of the present invention, the following steps are practiced: (a) Applying a piece of transfer tape to the rear face of the paper ply so that it extends from the top edge to the bottom edge of the paper ply and is adhesively secured thereto. (b) Forming at least one die cut label from the front face of the paper ply over the transfer tape, while defining a die cut area surrounding the at least one label. And, (c) removing the die cut area surrounding the at least one label. Step (b) is preferably practiced to form a plurality of die cut labels, and steps (a) and (b) are practiced to define a large area of a front face not covered with transfer tape on the rear thereof, and there is the further step of printing the large area. There also preferably is the further step of printing the labels, and the printing steps may be practiced simultaneously. The printing steps may be practiced by driving the business form through a printer using the tractor openings in the form to effect driving. There also may be provided the further step of forming a perforation in the paper ply substantially at an edge of the transfer tape so that the large area can be removed from the transfer tape area.

It is the primary object of the present invention to provide a simple yet effective business form—and method of production thereof—having at least one removable label associated with it. This and other objects of the invention will become clear from an inspection of the detailed description of the invention, and from the appended claims.

DETAILED DESCRIPTION OF THE DRAWINGS

Figure 1:
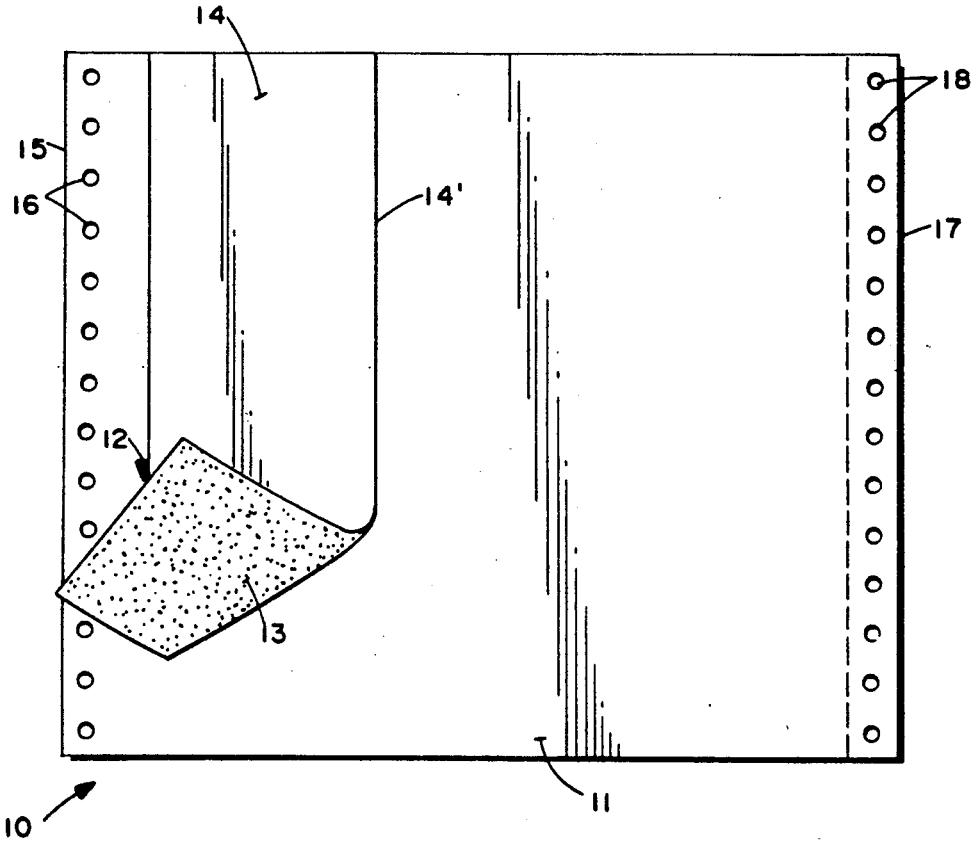
FIG. 1 is a rear view of a single part business form according to the present invention during the application of transfer tape thereto in the construction of the form.
Figure 2:
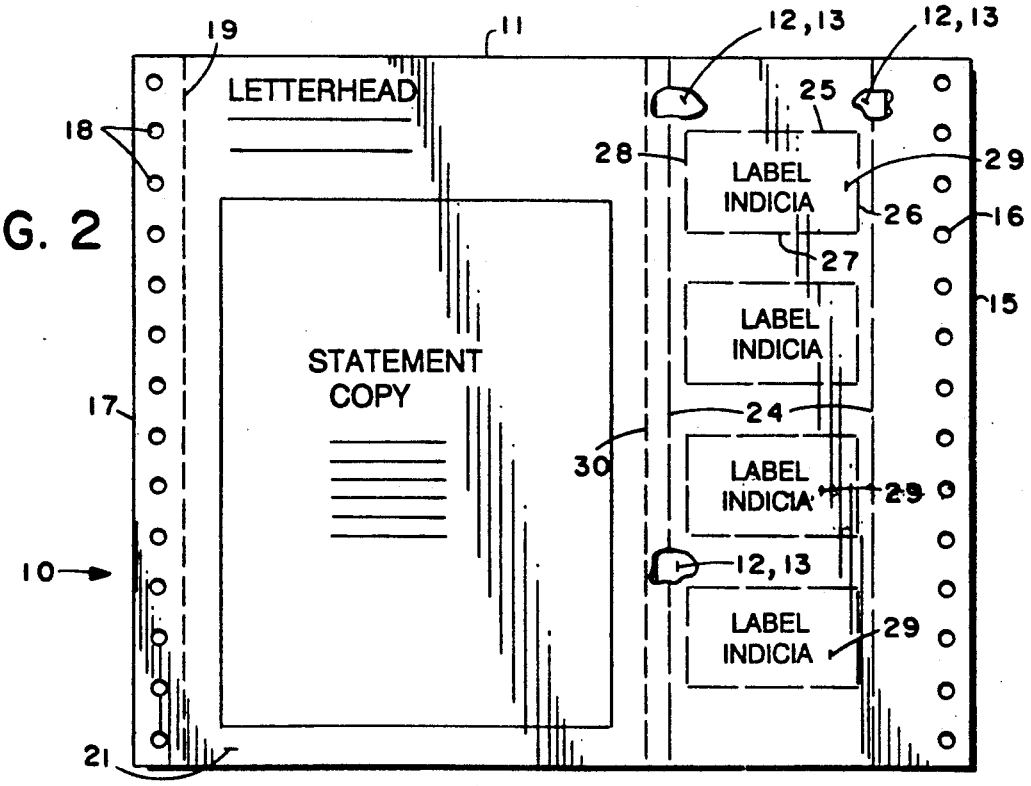
FIG. 2 is a front view of a form according to the present invention during an intermediate stage.
Figure 3:
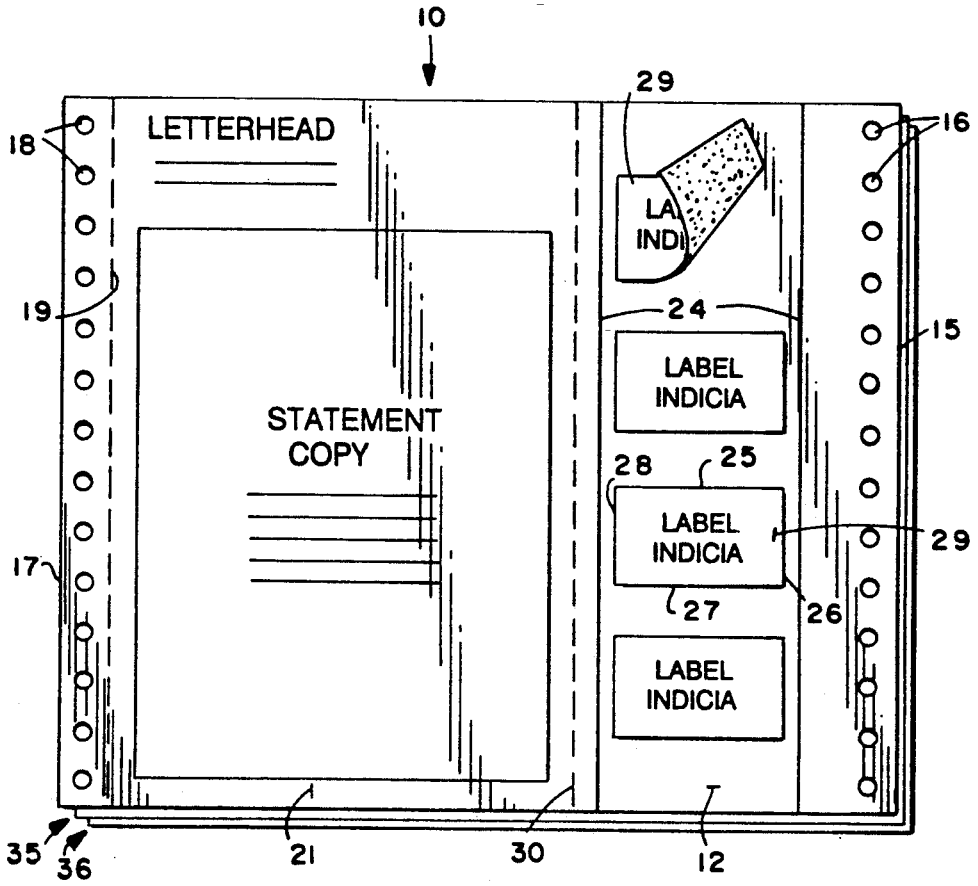
FIG. 3 is a front view of the form of FIG. 2 when completed, and also showing it as the top part of a multi part form.

A business form according to the present invention is shown generally by reference numeral 10 in FIGS. 1 through 3. The form includes a paper ply 11 which has a piece of transfer tape 12 with an adhesive 13 covered release face, and a non-adhesive covered back face 14. As illustrated in FIG. 1, the transfer tape 12 preferably is applied to the rear face of the paper ply 11, and extends all the way from the top to the bottom of the paper ply 11, with the side edges (14', and edge opposite it) of the transfer tape 12 parallel to the side edges 15, 17, of the paper ply 11.

While the paper ply 11 may be a cut sheet, preferably it is part of a continuous form, and is burst from the rest of the continuous forms after it has been acted upon according to the method of the invention.

Adjacent the side edges 15, 17 of the paper ply 11 are tractor openings 16, 18 respectively. Preferably a perforation 19 is provided adjacent the tractor openings 18 at the first edge 17 of the paper ply 11. No such perforation is required at the opposite edge of the form, but may be provided.

During the construction of the final form, a large area 21 is preferably provided to the left of the transfer tape 12—as viewed in FIG. 2—which comprises a statement, letter, or other business form document. The area 21 is preferably wider than the transfer tape 12, i.e. the spacing between tractor openings 16, 18 is at least twice as great as the width of the transfer tape 12.

Formed in the top face of the paper ply 11 are a plurality of die cuts, such as the die cuts 24 through 28.

The die cuts 24 define a removable die cut area (33), while the die cuts 25 through 28 collectively define at least one label 29. Preferably a plurality of labels 29 are provided. Each label 29 comprises a removed die cut portion of the paper ply 11 and the adhesive 13 from the transfer tape 12 which is beneath the area of the paper ply 11 from which the labels 29 are formed.

Preferably, a perforation 30 also is provided which is essentially in alignment with the interiormost edge (e.g. edge 14' as seen in FIG. 1) of the transfer tape 12. The perforations 19, 30 allow detachment of the business form document 21 from the rest of the business form.

Figure 4:
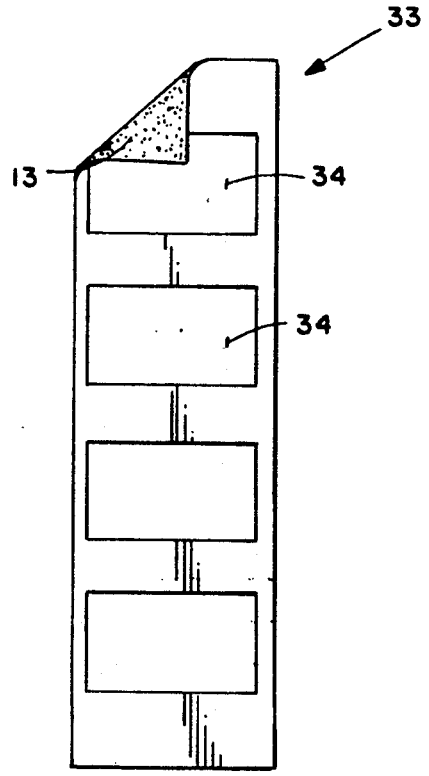
FIG. 4 is a front of the removed die cut area from the form of FIG. 3.

While the form 10 illustrated in FIG. 2 can be a final form, preferably the final configuration of the form is as illustrated in FIG. 3. In this case, the die cut area 33 (see FIG. 4) has been removed from the rest of the form 10, exposing the underlying transfer tape 12. Note that the die cut area 33 has "windows" 34 formed therein, which are where what is now the labels 29 used to be. Removing the die cut area 33 makes the individual labels 29 easier to remove and utilize when the ultimate user receives the final form 10.

While the form 10 can be a single part form, as illustrated in FIG. 3 it may also be the top part of a multi ply form, e.g. a two part, three part, or four or more part form. In FIG. 3 it is illustrated as the top part of a three part form, there being paper plies 35, 36 beneath it. The plies 35, 36 may be identical to the paper ply 11 without the transfer tape 12, including having tractor openings therein, and perforations corresponding to the perforations 19, 30; alternatively, the underlying plies 35, 36 may end at the perforations 30. The underlying plies 35, 36 are attached to the top ply in any conventional manner.

In the practice of the method according to the present invention, the following steps are provided:

A piece of transfer tape 12 is applied to the rear face of the paper ply 11 so that it extends from the top edge to the bottom edge of the paper ply, with adhesive 13 against the rear face of ply 11.

At least one die cut label 29 is formed from the front face of the paper ply 11 over the transfer tape 12, while defining a die cut area 33 surrounding the label(s).

The form 10 can be passed through a printer with printing applied to the top face of both the main portion 21 thereof as well as the labels 29, either in separate steps, or simultaneously. The form 10 can be fed through a computer controlled printer utilizing the tractor holes 18, 16, and can be done in continuous form with the individual forms 10 burst after printing.

After otherwise completing the form, the die cut area 33 is removed (either manually, or automatically) to produce the form 10 as seen in FIG. 3.

When the form 10 is received by the ultimate user, the main body 21 can be separated at the perforations 19, 30 from the rest of the form 10. The individual labels 29—which are easily accessible—can be removed from over the transfer tape 12, then applied either to the main body 21, on a return envelope, or to any other object, form, or paper.

It will thus be seen that according to the present invention a simple yet effective business form having at least one removable label associated with it has been provided, as well as a method of manufacture thereof. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and processes.

What is claimed is:

1. A business form having at least one label associated therewith and removable therefrom, comprising:

a paper ply having a front face and a rear face, and having first and second side edges parallel to each other and having means defining tractor feed openings adjacent said first and second edges;

a piece of transfer tape having an adhesive covered release face and a non-adhesive covered back face, and a pair of parallel side edges;

said adhesive face of said transfer tape attached to said paper ply rear face with said side edges of said transfer tape between said tractor openings, and said transfer tape edges parallel to said first and second edges; and at least one die cut formed in said paper ply front face to define, with adhesive from said transfer tape, at least one removable label.

2. A business form as recited in claim 1 wherein said paper ply has top and bottom edges, and wherein said transfer tape extends from said top edge to said bottom edge.

3. A business form as recited in claim 2 wherein the distance between said tractor openings is much greater than the spacing between said side edges of said transfer tape.

4. A business form as recited in claim 3 formed originally as a continuous form wherein the distance between said tractor openings is at least twice as great as the spacing between said side edges of said transfer tape.

5. A business form as recited in claim 3 further comprising a perforation formed in said paper ply approximately at one of said side edges of said transfer tape.

6. A business form as recited in claim 5 wherein said at least one label comprises a plurality of labels.

7. A business form as recited in claim 6 further comprising a die cut area surrounding said labels, said surrounding die cut area removed so that said release face of said transfer tape is exposed at the edges of said labels.

8. A business form as recited in claim 7 further comprising a perforation formed at said first edge of said paper ply just inside said tractor openings adjacent said first edge, said perforation being spaced a significant distance from said transfer tape; and wherein an edge of said transfer tape is adjacent, but spaced from, said tractor openings adjacent said second edge of said transfer tape.

9. A business form as recited in claim 8 wherein said ply comprises the top ply of a multi-part paper business form.

10. A business form as recited in claim 1 further comprising a perforation formed in said paper ply approximately at one of said side edges of said transfer tape.

11. A business form as recited in claim 1 wherein said at least one label comprises a plurality of labels.

12. A business form as recited in claim 11 further comprising a die cut area surrounding said labels, said surrounding die cut area removed so that said release face of said transfer tape is exposed at the edges of said labels.

13. A business form as recited in claim 1 further comprising a perforation formed at said first edge of said paper ply just inside said tractor openings adjacent said first edge, said perforation being spaced a significant distance from said transfer tape; and wherein an edge of said transfer tape is adjacent, but spaced from, said tractor openings adjacent said second edge of said transfer tape.

14. A method of making a business form having at least one removable label associated therewith, utilizing a paper ply having front and rear faces, top and bottom parallel edges spaced from each other, and first and second parallel side edges spaced from each other, comprising the steps of:

(a) applying a piece of transfer tape to the rear face of the paper ply so that it extends from the top edge to the bottom edge of the paper ply and is adhesively secured thereto;

(b) forming at least one die cut label from the front face of the paper ply over the transfer tape, while defining a die cut area surrounding the at least one label; and (c) removing the die cut area surrounding the at least one label.

15. A method as recited in claim 14 wherein step (b) is practiced to form a plurality of die cut labels, with the die cut area surrounding the labels.

16. A method as recited in claim 15 wherein steps (a) and (b) are practiced to define a large area of the front face not covered with transfer tape on the rear thereof; and comprising the further step of printing the large area.

17. A method as recited in claim 16 comprising the further step of printing the labels.

18. A method as recited in claim 17 wherein said printing steps are practiced substantially simultaneously.

19. A method as recited in claim 17 wherein the paper ply has tractor openings formed in it adjacent the first and second edges thereof; and wherein said printing steps are practiced by driving the business form through a printer using the tractor openings to effect driving.

20. A method as recited in claim 16 comprising the further step of forming a perforation in the paper ply substantially at an edge of the transfer tape so that the large area can be removed from the transfer tape.

* * * * *